US005736693A

United States Patent [19]

Piech et al.

[11] Patent Number: 5,736,693

[45] Date of Patent: Apr. 7, 1998

[54] ELEVATOR DOOR DRIVE USING DUAL SECONDARY LINEAR INDUCTION MOTOR

[75] Inventors: Zbigniew Piech, East Hampton; Jerome F. Jaminet, South Windsor; Thomas M. Kowalczyk, Farmington, all of Conn.; Edward E. Ahigian, Arlington Heights, Ill.; Richard E. Kulak, Bristol, Conn.; Thomas M. McHugh, Farmington, Conn.; Thomas He, Unionville, Conn.; Richard E. Peruggi, Glastonbury, Conn.; David W. Barrett, East Hartland, Conn.

[73] Assignee: Otis Elevator Company, Farmington, Conn.

[21] Appl. No.: 533,595

[22] Filed: Sep. 25, 1995

[51] Int. Cl.[6] ..... B66B 13/14

[52] U.S. Cl. ..... 187/316; 310/12; 49/118

[58] Field of Search ..... 187/316, 289; 310/2, 1; 49/118

[56] References Cited

U.S. PATENT DOCUMENTS

| | | | |
|---|---|---|---|
| 3,462,883 | 8/1969 | Reeks et al. | 49/360 |
| 3,708,915 | 1/1973 | Davey | 49/340 |
| 3,793,944 | 2/1974 | Grubich et al. | 100/53 |
| 3,872,622 | 3/1975 | Berk | 49/118 |
| 3,891,907 | 6/1975 | Lenzkes et al. | 318/369 |
| 3,895,585 | 7/1975 | Schwärzler | 104/148 LM |
| 4,067,144 | 1/1978 | Ogishi | 49/360 |
| 4,090,113 | 5/1978 | Ogishi | 318/282 |
| 4,172,229 | 10/1979 | Guimbal | 310/12 |
| 4,188,552 | 2/1980 | Brimer | 310/13 |
| 4,305,481 | 12/1981 | Hmelovsky et al. | 187/29 R |
| 4,365,442 | 12/1982 | Speer | 49/346 |
| 4,698,876 | 10/1987 | Karita | 16/102 |
| 4,858,452 | 8/1989 | Ibrahim | 70/275 |
| 4,876,765 | 10/1989 | Karita | 16/102 |
| 5,134,324 | 7/1992 | Sakagami et al. | 310/12 |
| 5,172,518 | 12/1992 | Yshino | 49/360 |
| 5,235,226 | 8/1993 | Olson et al. | 310/12 |
| 5,373,120 | 12/1994 | Barrett et al. | 187/316 |
| 5,612,518 | 3/1997 | Jaminet et al. | 187/316 |
| 5,668,355 | 9/1997 | Jaminet et al. | 187/316 |

FOREIGN PATENT DOCUMENTS

| | | |
|---|---|---|
| 3264486 | 11/1991 | Japan . |
| 1148444 | 4/1969 | United Kingdom . |

OTHER PUBLICATIONS

"Linear direct drives featuring three–phase asynchronous motors", a brochure from Automation & Servo Technologies, Inc. a U.S. representative of Kraus Maffei AG, Jan. 19, 1993.

*Primary Examiner*—Robert Nappi

[57] ABSTRACT

A linear induction motor utilizes a double-sided primary and a dual secondary to directly drive an elevator car door open and closed. The invention has the advantage of being compact: all magnetic-attractive loads are confined to a primary mount bracket, and all thrust loads are carried directly by the car header, not transferred to the cab. Also, high thrusts can be developed from a small space, i.e., short net working coil area, due to the double-sided primary winding and dual secondary arrangement. The configuration is basically simple, with a low moving mass and easy-to-fabricate parts, the primary core being particularly easily wound.

3 Claims, 5 Drawing Sheets

FIG.4
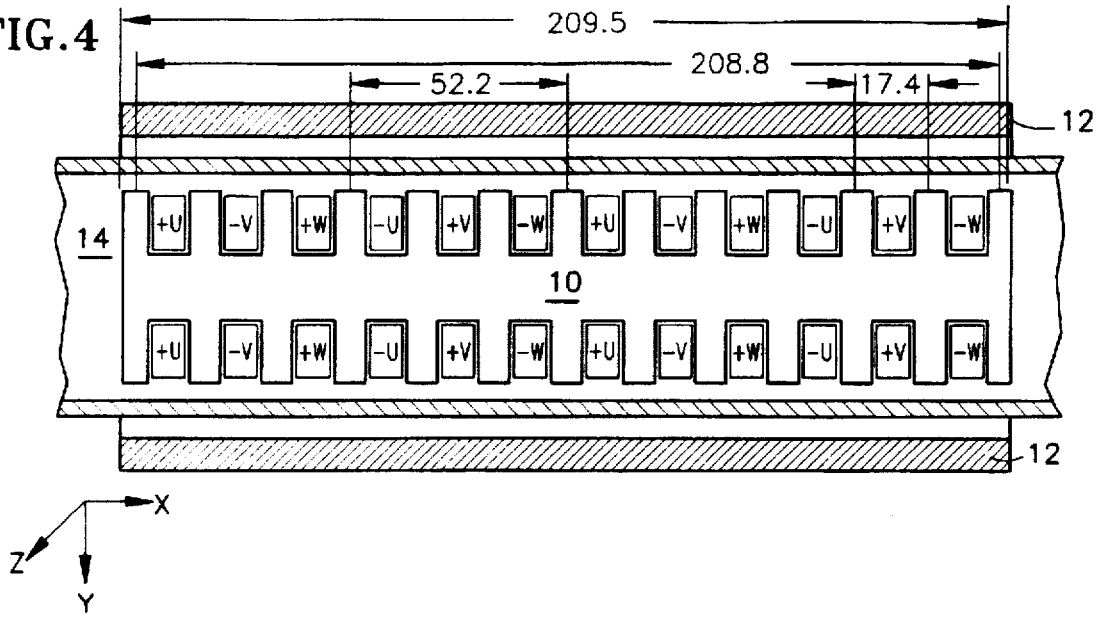
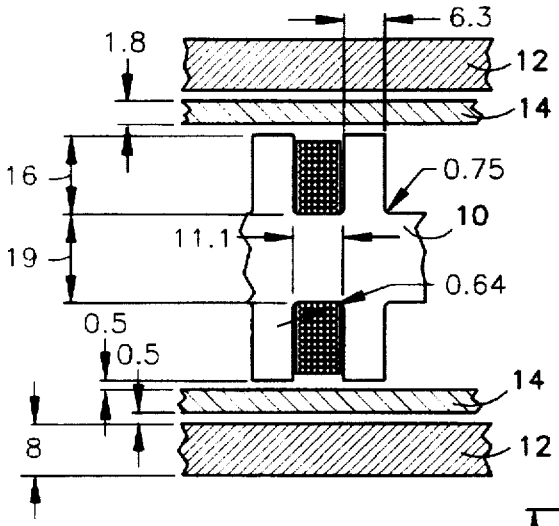
FIG.5
FIG.6
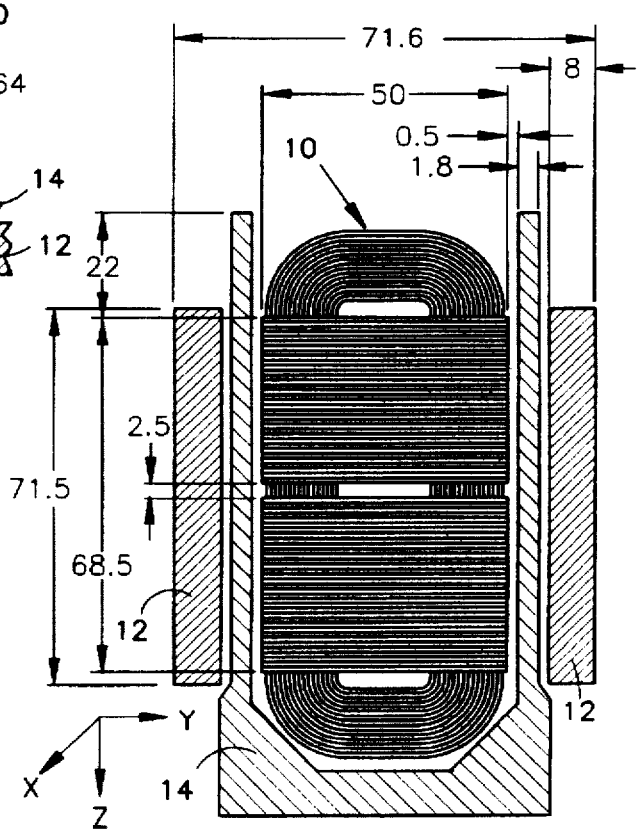

ELEVATOR DOOR DRIVE USING DUAL SECONDARY LINEAR INDUCTION MOTOR

TECHNICAL FIELD

This invention relates to elevators and, more particularly, to a linear motor for actuating an elevator door.

BACKGROUND OF THE INVENTION

Almost all door drive systems for present-day elevators use a rotary motor with a complicated set of articulated arms to operate the doors. This configuration is necessary to convert the rotary motion of the motor to the linear motion of the doors. The motor is typically mounted on top of the cab and the doors driven at their centers of gravity, resulting in large forces/deflections on the arms and large forces and moments at the motor. These large motor loads and moments are transferred to the cab, requiring additional cab structure for stiffening purposes.

A linear door motor system for elevators is disclosed in U.S. Pat. No. 5,373,120, assigned to Assignee hereof. A linear induction motor (LIM) applies thrust directly to the moving car doors and is more easily manufactured and controlled to produce smooth motion. That system used a linear motor mounted on the elevator car and oriented to produce flux in the secondary, mounted on the top edge of the door, in such a way as to produce not only horizontal thrust forces but also magnetically levitate the door somewhat. That particular orientation is highly effective in installations where a fast door open time (e.g., one second) is demanded, along with low noise and high reliability. However, it is somewhat large, and the installation can be quite costly.

Naturally, it would be most advantageous to be able to use the linear motor concept for lower-cost elevators for the same reasons, i.e., replacing the old-style electromechanical door operator. However, the cost of the presently-implemented linear induction motor is quite high, and this, along with associated size and other costs, puts this innovation out of reach for most new equipment installations.

DISCLOSURE OF INVENTION

An object of the present invention is to provide a linear door motor system for elevators using a different approach, so that such a system can be widely used for many different types of elevator installations.

According to the present invention, a linear induction motor for driving an elevator door of an elevator car comprises a double-sided primary having a plurality of slots and teeth on two sides thereof for mounting on said car, a plurality of coils wound in said slots for connection to each other in a selected electrical configuration, and a dual secondary having two sides, one opposite each of said two sides of said double-sided primary, at least part of said dual secondary for mounting on said elevator door for moving with said door in relation to said elevator car, and said double-sided primary having said coils energized by a source of power.

The dual secondary can be made to comprise a two-sided backiron part for mounting on the car opposite each of the two sides of the double-sided primary, and a dual-sided conductive sheet part having two legs for insertion in gaps on either side of the double-sided primary between the two-sided backiron and the double-sided primary, wherein the dual sided conductive sheet is for mounting on the elevator door for moving therewith.

In the alternative, the dual secondary can comprise a two-sided backiron part for mounting on the elevator door, opposite each of the two sides of the double-sided primary, and a dual-sided conductive sheet part for mounting on each side of the two-sided backiron part in facing relation to the double-sided primary. Other orientations can be envisioned as well, according to the teachings hereof.

Thus, a compact linear induction motor utilizing a double-sided primary and dual secondaries is disclosed, which directly drives an elevator car door open and closed. As is commonly done, the hoistway door may be coupled to and driven by the car door. This invention has the advantage of being compact: all magnetic-attractive loads are confined to the primary mount bracket, and all thrust loads are carried directly by the car header to which it is attached, not transferred to the cab. Also, high thrusts can be developed from a small space (shorter networking coil area) due to the double-sided primary winding and dual secondary arrangement. The configuration is basically simple, with a low-moving mass and easy-to-fabricate parts, e.g., the primary core is easily wound.

These and other objects, features and advantages of the present invention will become more apparent in light of the detailed description of a best mode embodiment thereof, as illustrated in the accompanying drawing.

BRIEF DESCRIPTION OF THE DRAWING

FIG. 4 shows a sectional view of a dual secondary linear induction motor, according to the present invention.

FIG. 5 shows a portion of the motor of FIG. 4 in more detail.

FIG. 6 shows an end sectional view of the motor of FIG. 4 in the Y-Z plane thereof.

BEST MODE FOR CARRYING OUT THE INVENTION

Figure 1:
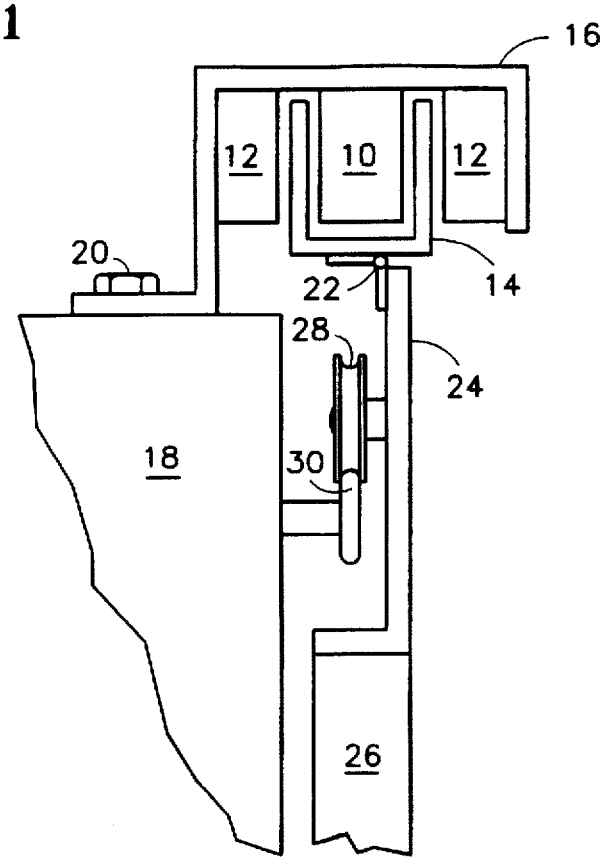
FIG. 1 shows a dual secondary linear induction motor, according to the present invention, for operating an elevator door.

FIG. 1 shows a dual secondary linear induction motor, according to the present invention, having a primary part 10 and a double-sided, two-part secondary comprising a double-sided backiron part 12 and a double-sided conductor part 14, such as copper. The dual secondary linear induction motor 10, 12, 14 is shown in section, as is a mounting bracket 16 mounted on the elevator car 18 and fastened thereto, e.g., by one or more screws 20. The double-sided secondary backiron part 12 is mounted on the bracket 16 on opposite sides of the primary part 10 which is mounted on the bracket as well between the two halves of the secondary backiron 12. The copper part 14 of the secondary 12, 14 has a U-shape and is attached at the bottom of the "U" to a hinge 22, which is in turn connected to a door hanger 24 attached to the top of an elevator door 26. Attached to an inner side of the door hanger 24 is a roller 28 which rests on a roller guide 30 which is, in turn, mounted on the car 18.

The double-sided primary part 10 and the double-sided secondary part 12 will have a length in the direction perpendicular to the surface of FIG. 1 that is relatively small, e.g., on the order of several hundred millimeters, while the copper part 14 of the secondary will have a length that is comparable to the width of the door. This is necessary because the parts 10, 12 of the dual secondary linear induction motor that are mounted to the bracket 16 are fixed to the car, while the door is movable with respect thereto. The linear induction motor utilizing the double-sided primary 10 and dual secondaries 12, 14 is used to directly drive the elevator car door 26 open and closed. Although not shown, a hoistway door at a landing may be coupled to and driven by the car door 26. As mentioned, the primary core and winding 10 (shown cross-hatched) is centrally located between the two fixed secondary backirons 12. The U-shaped moving secondary part 14 of the motor comprises an electrically conductive material such as copper or aluminum. Its two legs are located in two air gaps formed by the primary core winding and the two secondary backirons. It is attached to the door hanger 24 and door 26 by a hinge or other flexible device such that it is centrally positioned over a plurality of door rollers similar to the roller 28, the plane of which defines the fore/aft location of the door system center of gravity.

Figure 2:
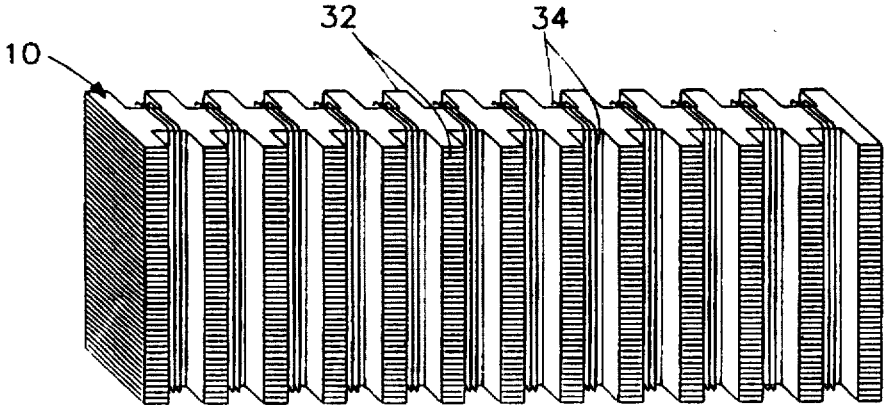
FIG. 2 shows a double-sided primary part of the linear motor of FIG. 1.

The double-sided primary core part 10 of the linear motor is shown in FIG. 2. It comprises a laminated iron core with matching teeth 32 and slots 34 cut on each side of the core. Concentric coils are wound around the core in each slot, as shown. Coils and connections for this primary core can be made as shown in the winding diagram of FIG. 3 or in any other selected configuration. Twelve coils are shown, one for each of the slots of FIG. 2. Each is shown associated with a particular phase U, V, W of a three-phase winding. Each coil is shown with a beginning (b) lead and an end lead (e). The connection points U1, V1, W1 and U2, V2, W2 are for connection to a source of power, e.g., through a motor drive (not shown).

FIG. 4 shows in plan view dimensions of a dual secondary linear induction motor, according to the present invention. It shows a primary part 10 and backiron part 12 of about 210 mm in length each. The width of each three-slot group for the three phase coils is shown as being about 52 mm, with each slot and tooth occupying about 17.4 mm.

FIG. 5 shows a portion of FIG. 4 in detail, showing the width of the primary 10 as about 51 mm and the width of each slot as about 11.1 mm. A slot of that size can hold a coil having about 255 turns using copper AWG 22 (0.643 mm outside diameter) wire. FIG. 5 also shows the thickness of each of the legs of the U-shaped part 14 of the secondary as being 1.8 mm, with a 0.5 mm gap on either side. The backiron part 12 of the secondary is shown as having a width of 8 mm.

All of this is shown in section in FIG. 6, which also shows the legs of the copper part 14 of the secondary extending beyond the primary part 10 by about 22 mm. Thus, the bracketing shown in FIG. 1 is a simplified representation of the actual bracketing necessary to support the primary and the backirons 12, taking into account the extension of the legs and the coils extending out of the ends of the primary. Although these details are not shown, it will be evident to one of skill in the art how to mount the primary and the backirons on the elevator car, taking all of these dimensions into account.

Figure 3:
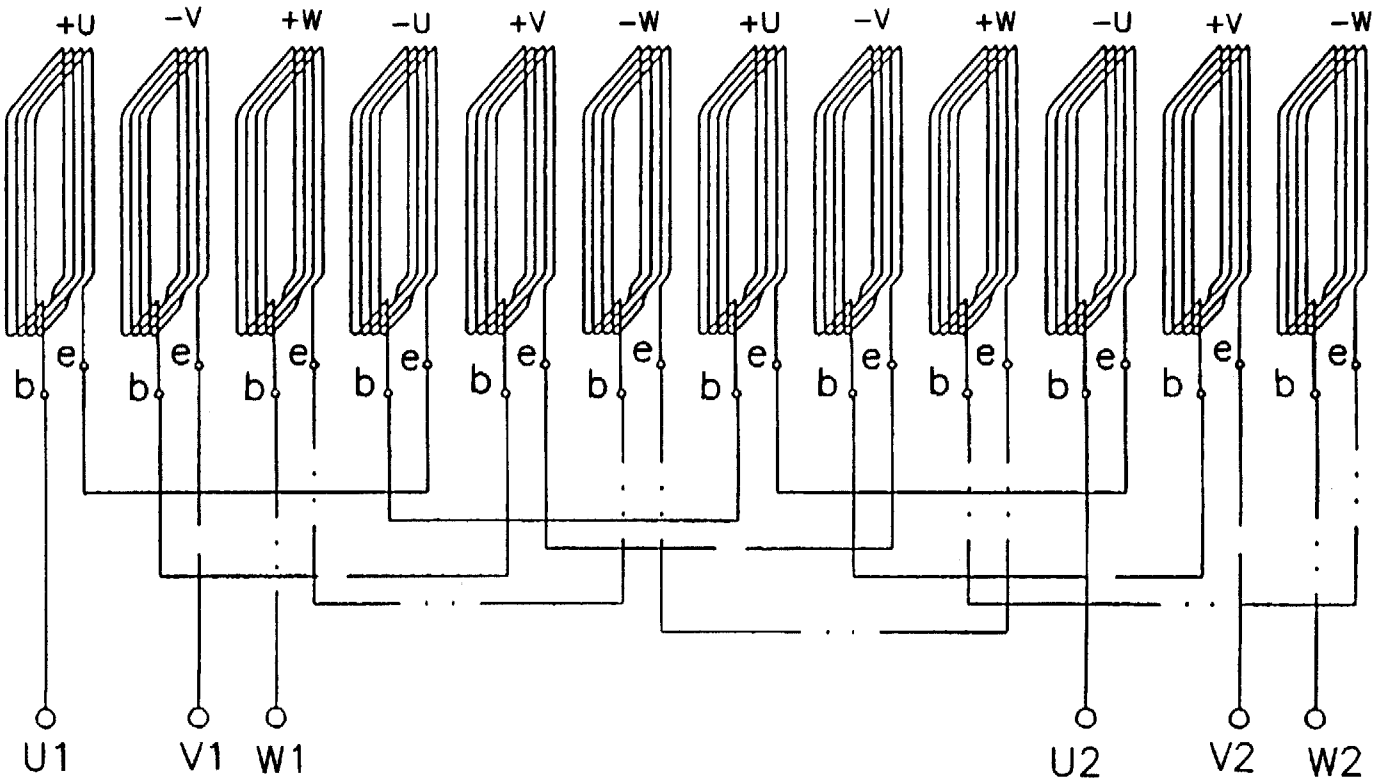
FIG. 3 shows a winding diagram for the double-sided primary part of FIGS. 1 and 2.

When the winding of FIG. 3 is supplied with three-phase AC power, the dual secondary linear induction motor of the present invention produces the necessary traveling magnetic field in the air gap on both sides of the primary core winding. The traveling magnetic field penetrates the conductive secondary sheets, inducing currents which create a linear thrust that moves the door assembly.

It should be realized that the just-described embodiment of the present invention is not the only way to carry it out, and certainly there are many other ways to make a dual secondary linear induction motor, according to the teachings hereof, for driving an elevator door. For instance, FIG. 7 shows another approach, according to the teachings hereof.

Figure 7:
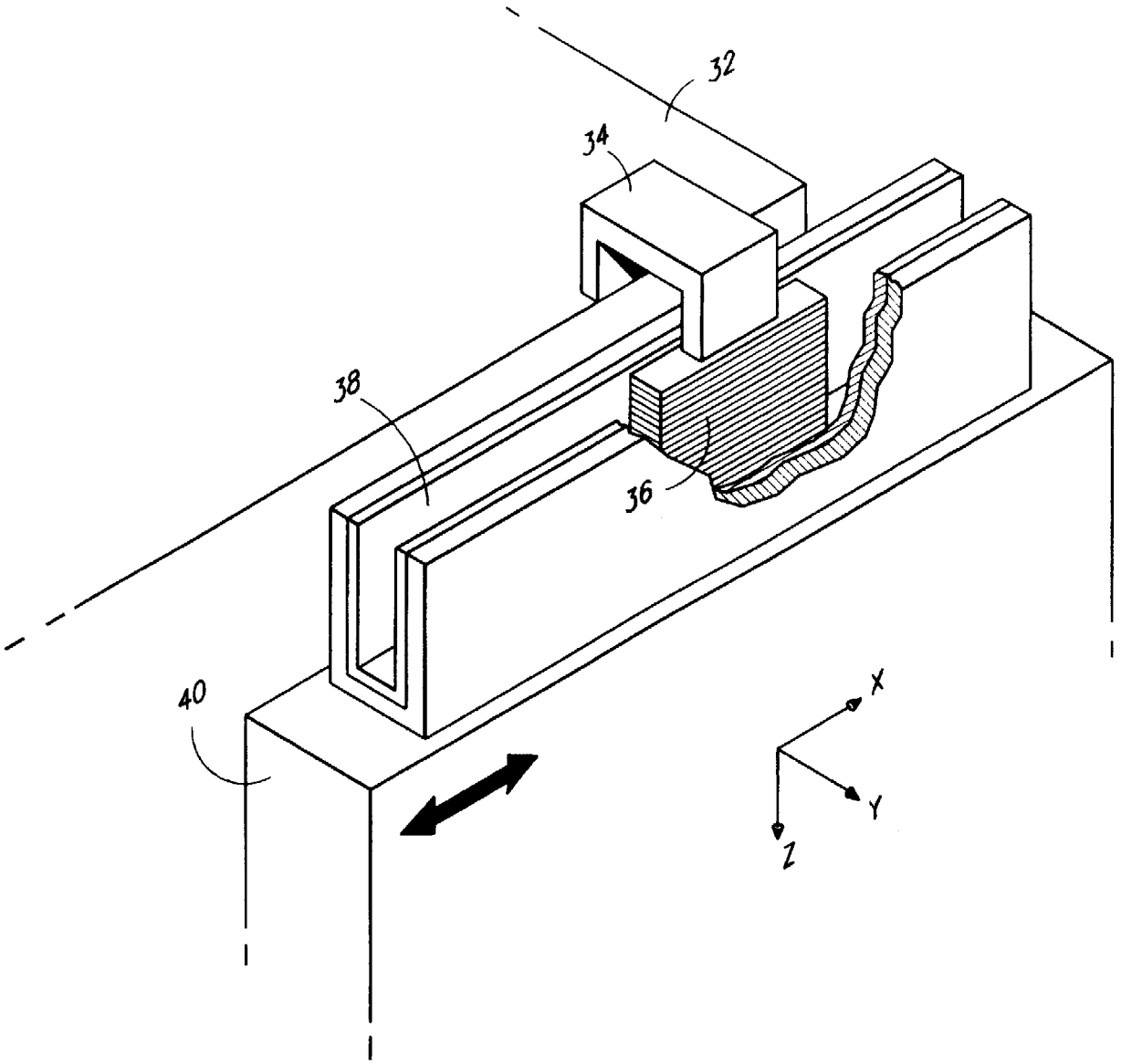
FIG. 7 shows an alternative embodiment of the dual secondary induction motor of the present invention.
Figure 8:
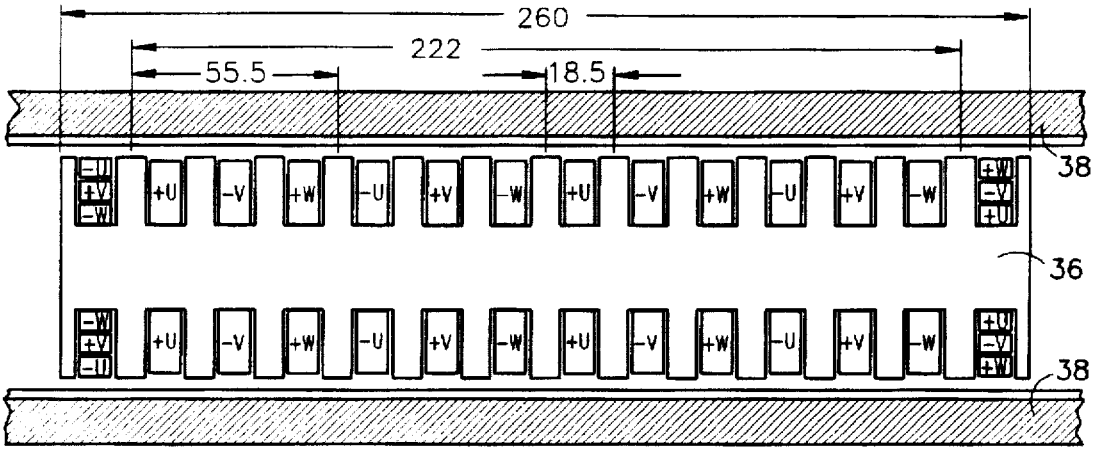
FIG. 8 shows a sectional view in the X-Y plane of FIG. 7 of the dual secondary linear induction motor thereof.
Figure 9:
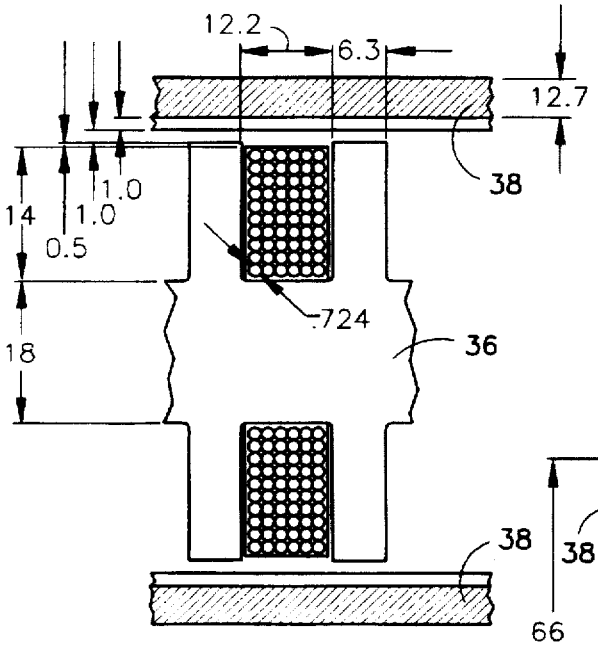
FIG. 9 shows a portion of FIG. 8 in more detail, showing a pair of opposite slots with a coil winding therein.
Figure 9:
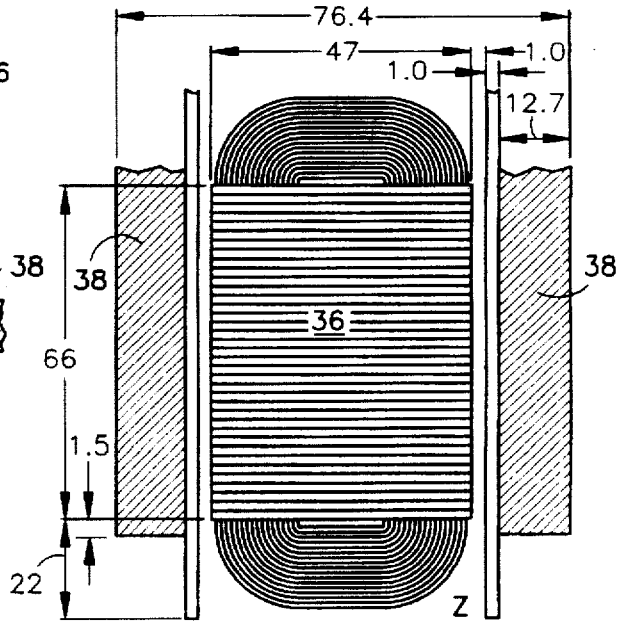
Figure 10:
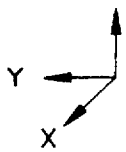
FIG. 10 shows an end sectional view of the dual secondary linear induction motor of FIG. 7 in the Y-Z plane thereof.

In FIG. 7, an elevator car 32 has a mounting component 34 attached at one end thereto and at another end to a linear motor primary part 36, which is inserted within a channel-shaped secondary 38 mounted on a movable elevator door 40. In this case, an outer part of the channel 38 is made of a ferromagnetic material, such as steel, while an inner lining is made of a more highly-conductive material such as copper or aluminum. In this case, the only part attached to the mount component 34 is the primary 36, while the secondaries 38 are designed in a single channel mounted on the door 40. In this case, there is only one gap on either side of the primary but there is still a dual secondary according to the teachings hereof. FIGS. 8–10 show detailed drawings for such an alternative embodiment for a dual secondary linear induction motor, according to the present invention. The embodiment of FIGS. 7–10 uses coils having 195 turns of copper wire of size AWG 21 (0.724 mm outside diameter).

FIG. 8 shows that, in addition to the 12 slots previously shown in connection with the first embodiment, two additional slots are provided at each end for compensation. The overall dimensions are slightly larger than the first embodiment, but are otherwise similar in concept, except for the copper part of the secondary being adjacent the backiron. The bracket 34 of FIG. 7 would be attached to the lower portion of the primary of FIG. 10, while the two legs of the channel would be joined by a connecting part of the channel (not shown) in the upper portion of FIG. 10. Thus, it will be realized that the copper sheet portion of the channel 38 of FIG. 7 can be made to extend beyond the steel portion of the channel in the leg area by about 22 mm beyond the top edge of the primary 36.

The linear induction motor of the present invention can be driven by a sophisticated electronic variable voltage/frequency motor drive such as used for the linear motor of U.S. Pat. No. 5,373,120, or may be driven by a TRIAC drive connected to the 50–60 Hz utility AC mains switched according to a control strategy such as a bang-bang approach, as disclosed in copending application U.S. Serial No. (Atty Docket OT-2032) in connection with FIGS. 5–10 thereof, beginning at page 10, line 16, through page 25, line 12, which is hereby incorporated by reference for background. Also incorporated by reference is a detailed description of such a TRIAC drive, as disclosed in copending U.S. application Serial No. (Atty Docket OT-2145), particularly FIGS. 5–11 thereof, beginning at page 10, line 10 and continuing through page 17, line 30, which is hereby incorporate by reference. This is all for background, is not essential to support the claims hereof, and need not be added hereto for the sake of brevity.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. A linear induction motor for driving an elevator door of an elevator car, comprising:

a double-sided primary having a plurality of slots and teeth on two sides thereof, for mounting on said car;

a plurality of coils wound in said slots for connection to each other in a selected electrical configuration, said double-sided primary having said coils energized by a source of power;

a two-sided backiron part for mounting on said car opposite each of said two sides of said double-sided primary; and a conductive sheet part having two legs for insertion in gaps on either side of said double-sided primary between said two-sided backiron and said double-sided primary, wherein said dual sided conductive sheet is for mounting on said elevator door for moving therewith, said conductive sheet part having a first side and a second side, said first side being disposed opposite said backiron part, said second side being disposed opposite said primary, said conductive sheet part comprising a single material in cross-section.

2. The linear induction motor of claim 1, wherein said two legs are joined by a connecting part to form said dual-sided conductive sheet part in a U-shape.

3. The linear induction motor of claim 2, wherein said door is attached to said connecting part by a hinged bracket having at least one roller mounted thereon for rolling on a roller guide attached to said car.

* * * * *